US007201614B2

(12) United States Patent
Cheng et al.

(10) Patent No.: US 7,201,614 B2
(45) Date of Patent: Apr. 10, 2007

(54) METHOD OF MAKING MICRO COAXIAL CONNECTOR

(75) Inventors: Wei Ya Cheng, Kunsan (CN); Hai Feng Fang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/951,504

(22) Filed: Sep. 27, 2004

(65) Prior Publication Data

US 2005/0070172 A1 Mar. 31, 2005

(30) Foreign Application Priority Data

Sep. 26, 2003 (CN) ..... 03135076.3

(51) Int. Cl.
*H01R 13/405* (2006.01)

(52) U.S. Cl. ..... 439/736; 439/936

(58) Field of Classification Search ..... 439/736, 439/660, 936, 606; 29/858, 883
See application file for complete search history.

(56) References Cited

U.S. PATENT DOCUMENTS

| | | | | |
|---|---|---|---|---|
| 4,824,394 | A * | 4/1989 | Roath et al. | 439/395 |
| 5,009,614 | A * | 4/1991 | Fogg et al. | 439/497 |
| 5,279,030 | A * | 1/1994 | Ito et al. | 29/883 |
| 6,123,582 | A | 9/2000 | Ko et al. | |
| 6,139,363 | A | 10/2000 | Ko et al. | |
| 6,155,886 | A * | 12/2000 | Koseki et al. | 439/736 |
| 6,206,722 | B1 | 3/2001 | Ko et al. | |
| 6,932,657 | B2 * | 8/2005 | Mizutani | 439/736 |
| 6,988,901 | B2 * | 1/2006 | Ribeau et al. | 439/79 |

* cited by examiner

*Primary Examiner*—Hien Vu
(74) *Attorney, Agent, or Firm*—Wei Te Chung

(57) ABSTRACT

A method of making a micro coaxial connector comprises the steps of: providing a number of terminals (20), assembling the terminals to an insulative first housing (10) to achieve a semi finished connector (100'), and molding the semi finished connector to a finished connector (100) with additional melt plastic. The melt plastic is formed into a second housing (13) and the terminals are retained by the first and second housings.

2 Claims, 7 Drawing Sheets

METHOD OF MAKING MICRO COAXIAL CONNECTOR

BACKGROUND OF THE INVENTION

1. Field of the Invention

The present invention generally relates to a method of making electrical connectors.

2. Description of Related Art

A conventional micro coaxial connector as disclosed in U.S. Pat. No. 6,123,582 comprises a housing, a plurality of electrical terminals received in the housing and a cable set with a plurality of cables. The method of making this kind of micro coaxial connector is known to common technicians in this field. The housing is injection molded while the electrical terminals are stamped. The terminals are interferentially retained in passageways defined in the housing. Generally, the terminal is sized a little smaller than the passageway so that the terminals are easily inserted into the corresponding passageways. However, this method results in insufficient retention force between the terminals and the housing.

As known to all, micro coaxial connectors are generally used for connecting components of the computer for signal transmission therebetween. The trend of the computer industry continues toward miniaturization, the computers all require an efficient use of the internal space thereof to contain more hardware therein. It is needed that micro coaxial connector takes up the least space, so housings and electrical terminals need to be miniaturely sized. Since the terminals interferentially mate with the housing, the housing is easily outwardly deformed in the course of inserting the terminals into the housing.

Hence, an improved method of making micro coaxial connectors is highly desired to overcome the disadvantages of the prior art.

SUMMARY OF THE INVENTION

Accordingly, an object of the present invention is to provide a method of making a micro coaxial connector, which improves the retention force between terminals and a housing of the connector.

Another object of the present invention is to provide a method of making a micro coaxial connector for preventing a housing of the connector from deformed when terminals of the connector mate with the housing.

In order to achieve the objects set forth, a method of making a micro coaxial connector comprises the steps of: providing a housing defining a plurality of passageways therein, providing a plurality of terminals each comprising a retention portion for retaining the terminals in the housing, assembling the terminals to the passageways so as to achieve a semi finished connector and molding the semi finished connector to achieve a finished connector.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
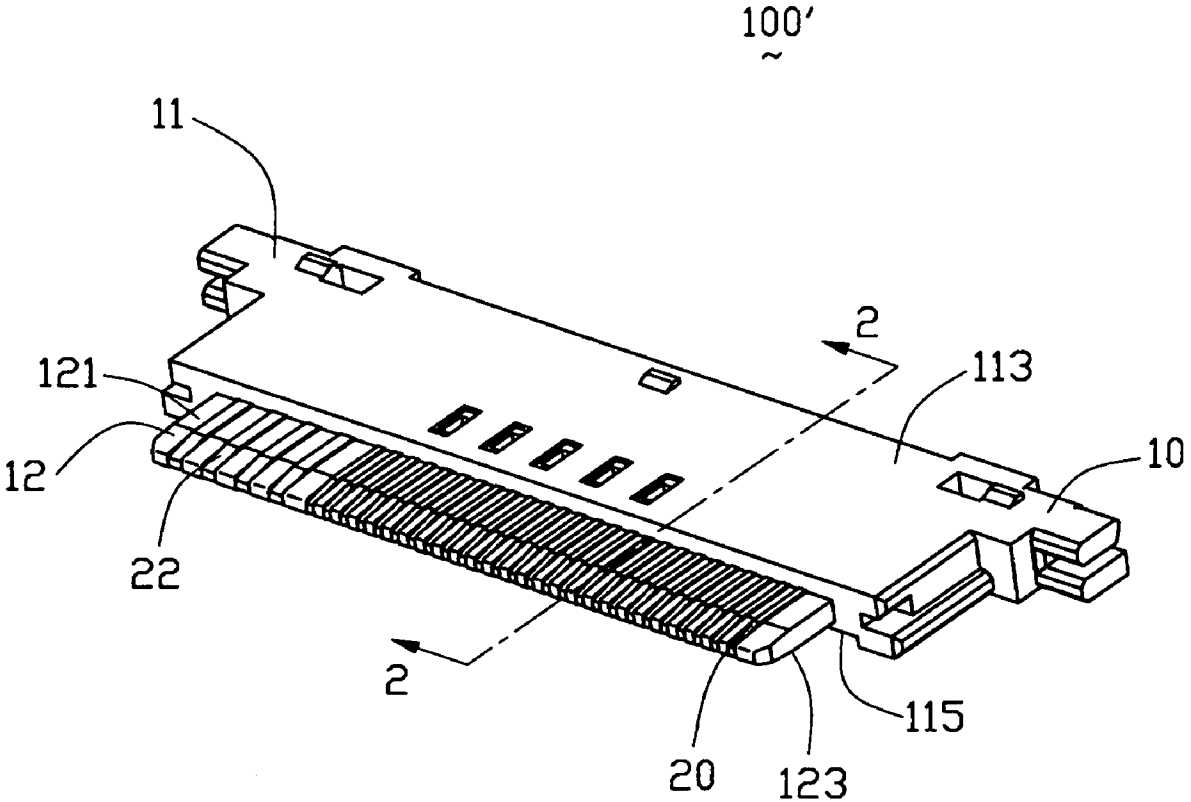
FIG. 1 is a perspective view of a semi finished micro coaxial connector manufactured by a method in accordance with the present invention.
Figure 3:
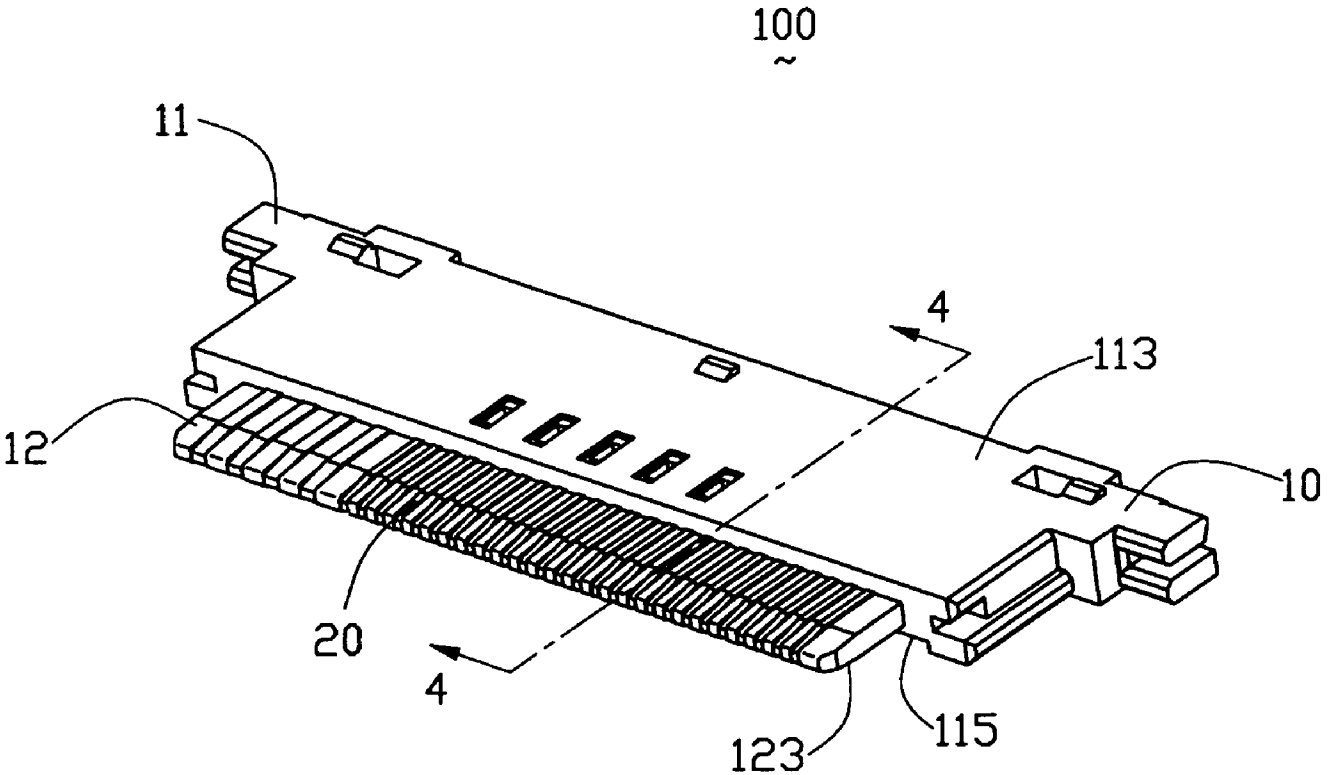
FIG. 3 is a perspective view of a finished micro coaxial connector manufactured by a method in accordance with the present invention.
Figure 7:
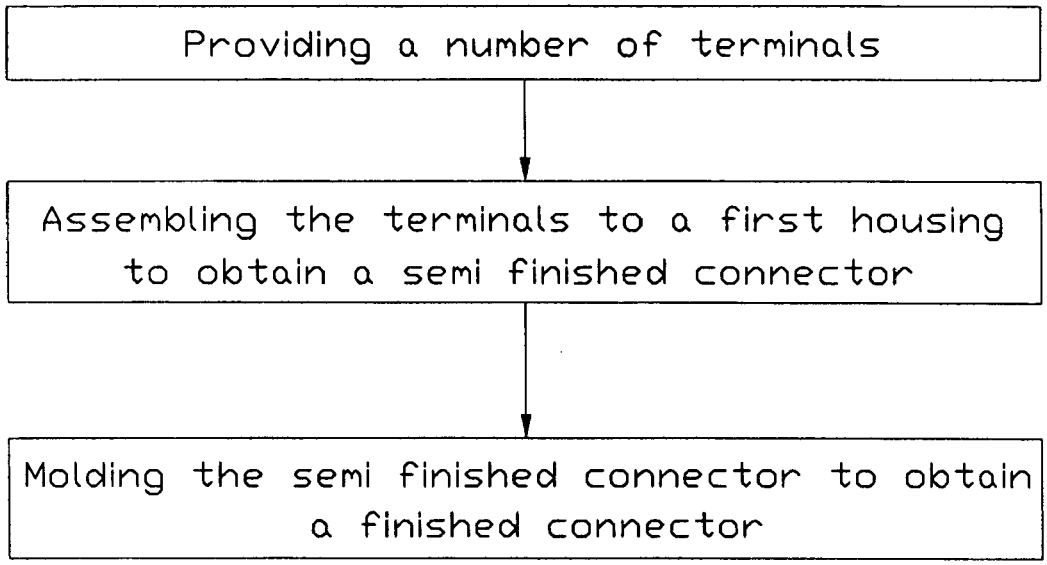
FIG. 7 is a flow chart of the method in accordance with the present invention.

Referring to FIGS. 1, 3 and 7, a method of making a micro coaxial connector 100 comprises providing a first housing 10, providing a plurality of electrical terminals 20, assembling the terminals 20 to the first housing 10 to achieve a semi finished connector 100' and molding the semi finished connector 100' to a finished connector 100.

Figure 2:
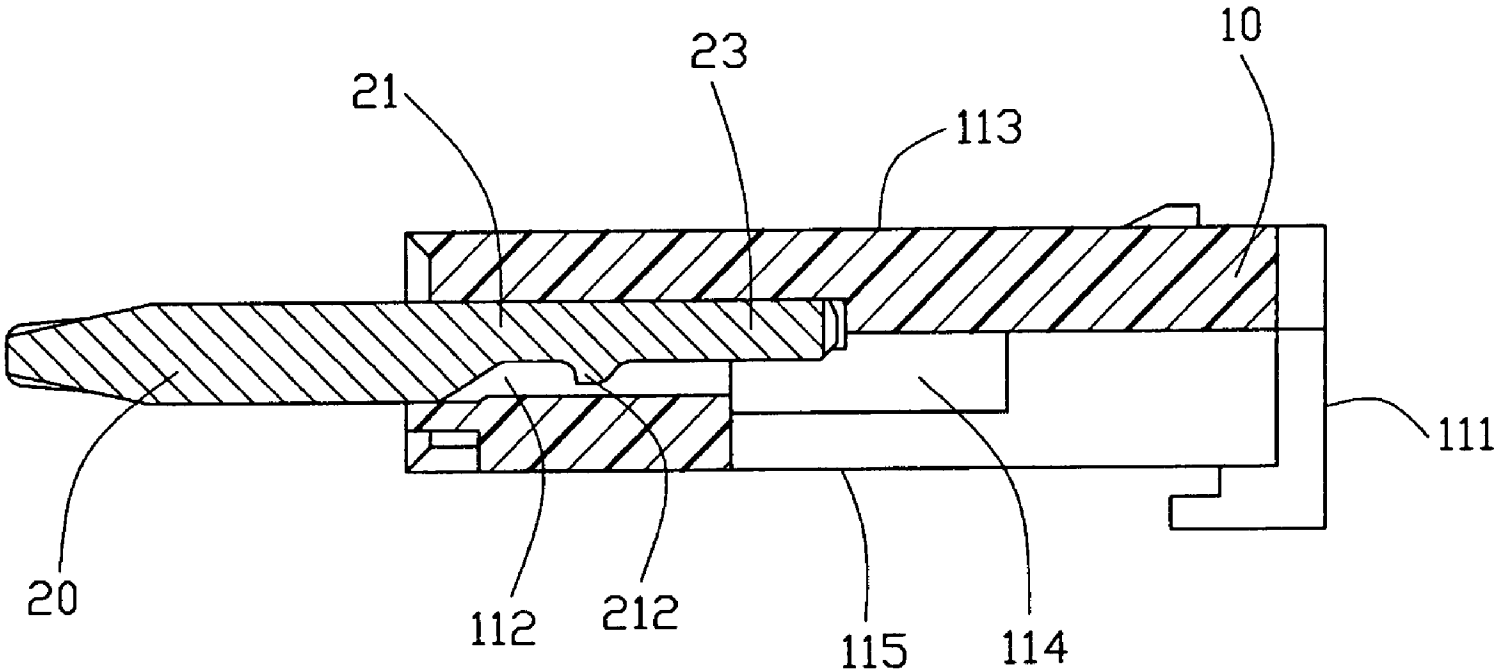
FIG. 2 is a cross-sectional view of the semi finished micro coaxial connector, taken along line 2—2 of FIG. 1.
Figure 5:
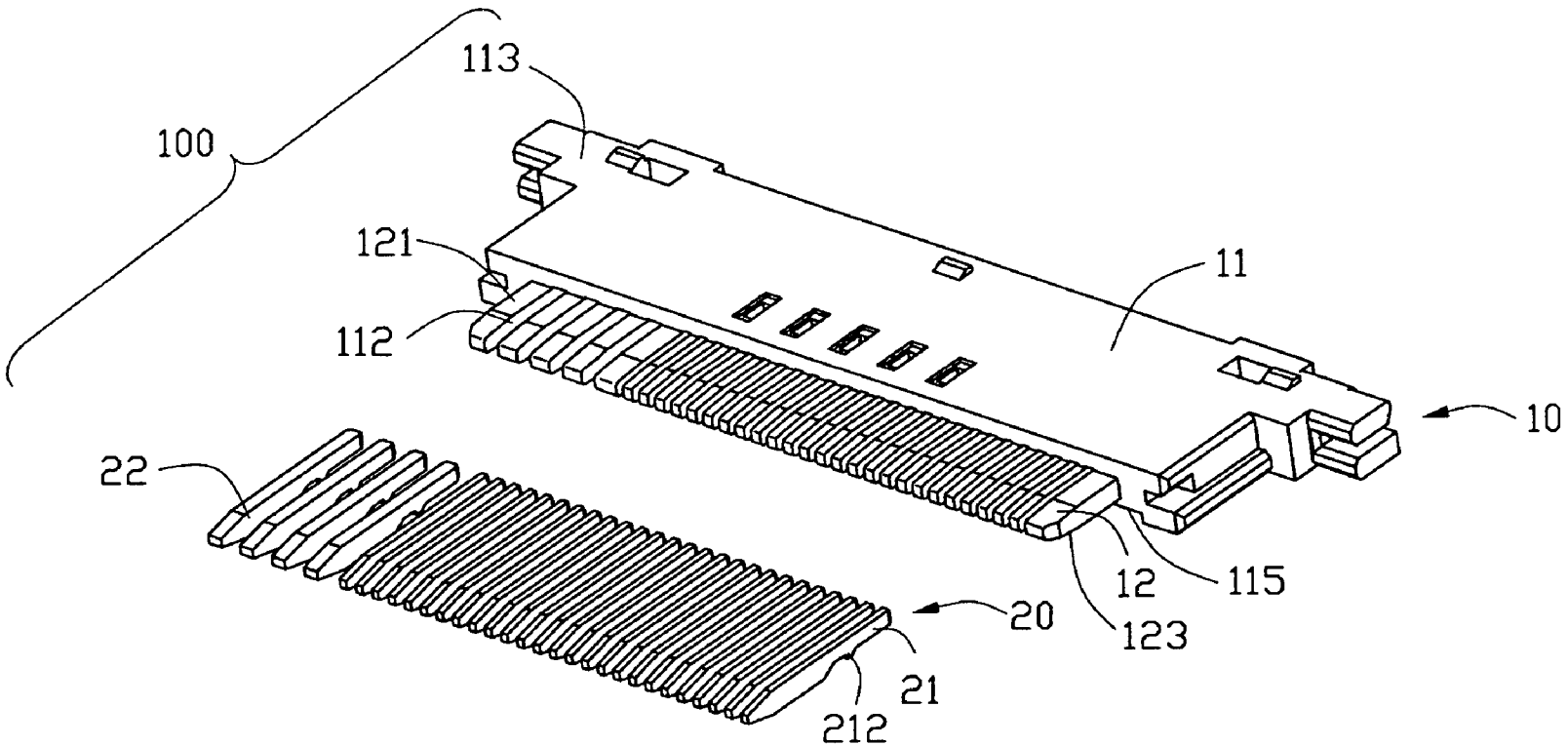
FIG. 5 is an exploded, perspective view of the finished micro coaxial connector manufactured by a method in accordance with the present invention.
Figure 6:
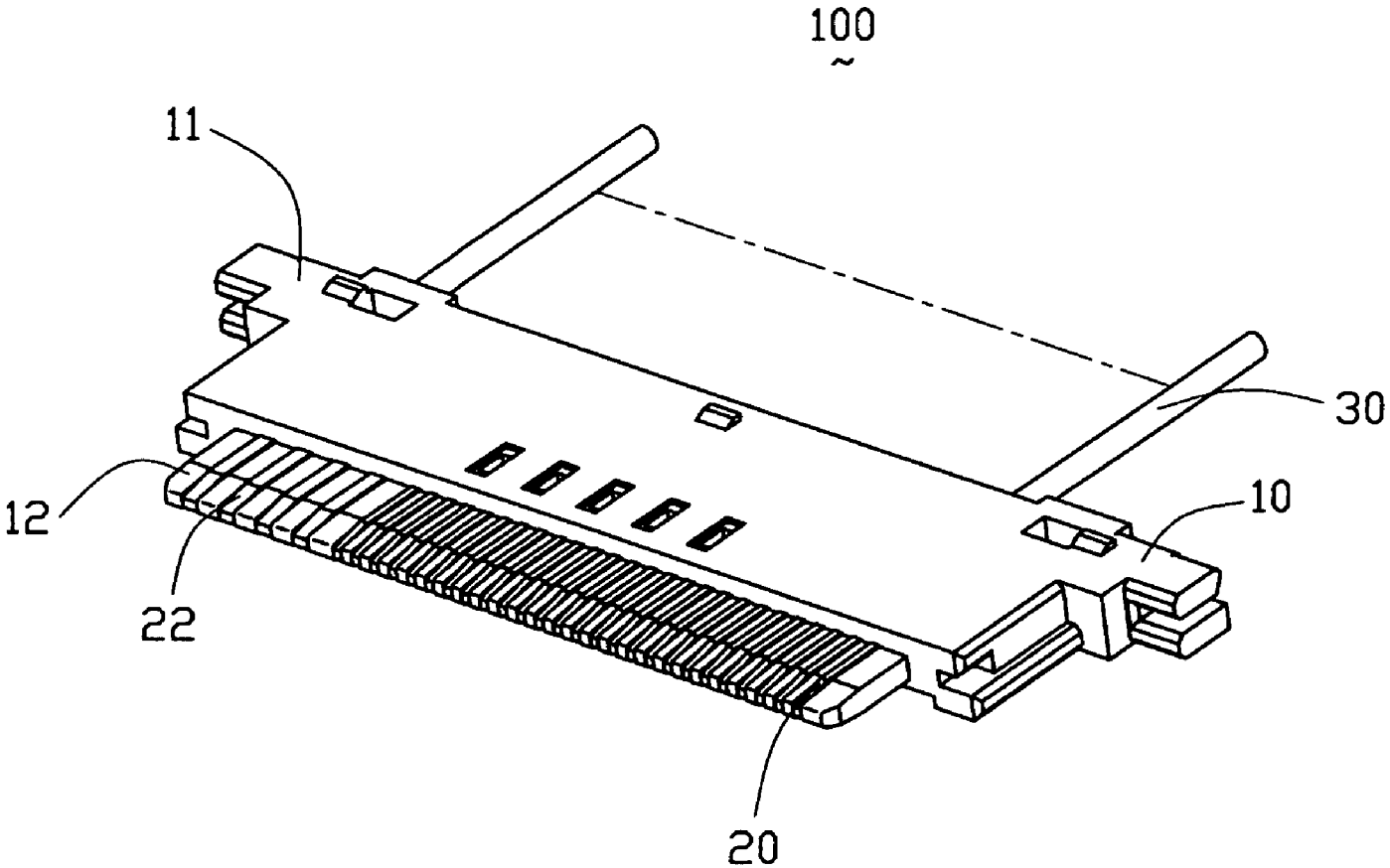
FIG. 6 is a perspective view of the finished micro coaxial connector mating with cables.

Referring to the FIG. 5 in conjunction with FIGS. 2 and 6, the first housing 10 is injection molded and comprises a base 11 and a tongue portion 12 extending from the base 11. The base 11 comprises a first upper surface 113 and a first lower surface 115. The tongue portion 12 comprises a second upper surface 121 and a second lower surface 123. The first upper surface 113 is higher than the second upper surface 121, while the first lower surface 115 is lower than the second surface 123. The tongue portion 12 defines a plurality of passageways 112 extending therethrough and into the base 11. The base 11 comprises a rear surface 111 defining a plurality of channels 114 extending therein. Each of the channels 114 is used for receiving a cable 30 and is communication with one corresponding passageway 112.

The terminals 20 are formed by stamping and pressing. Each of the terminals 20 comprises a retention portion 21, a contact portion 22 extending from the retention portion 21 and a tail portion 23 extending from the retention portion 21 and opposite to the contact portion 23. The retention portion 21 is formed with a plurality of barbs 212 for enhancing a retention force between the terminals 21 and the first housing 10.

Referring to FIG. 1 and FIG. 2, after assembling the terminals 20 to the first housing 10, the semi finished connector 100' is achieved. It can be seen from FIG. 2 that the passageways 112 are apparently sized larger than the terminals 20, so the terminals 20 can be easily assembled into passageways 112 and are retained in passageways 112 by interference.

Figure 4:
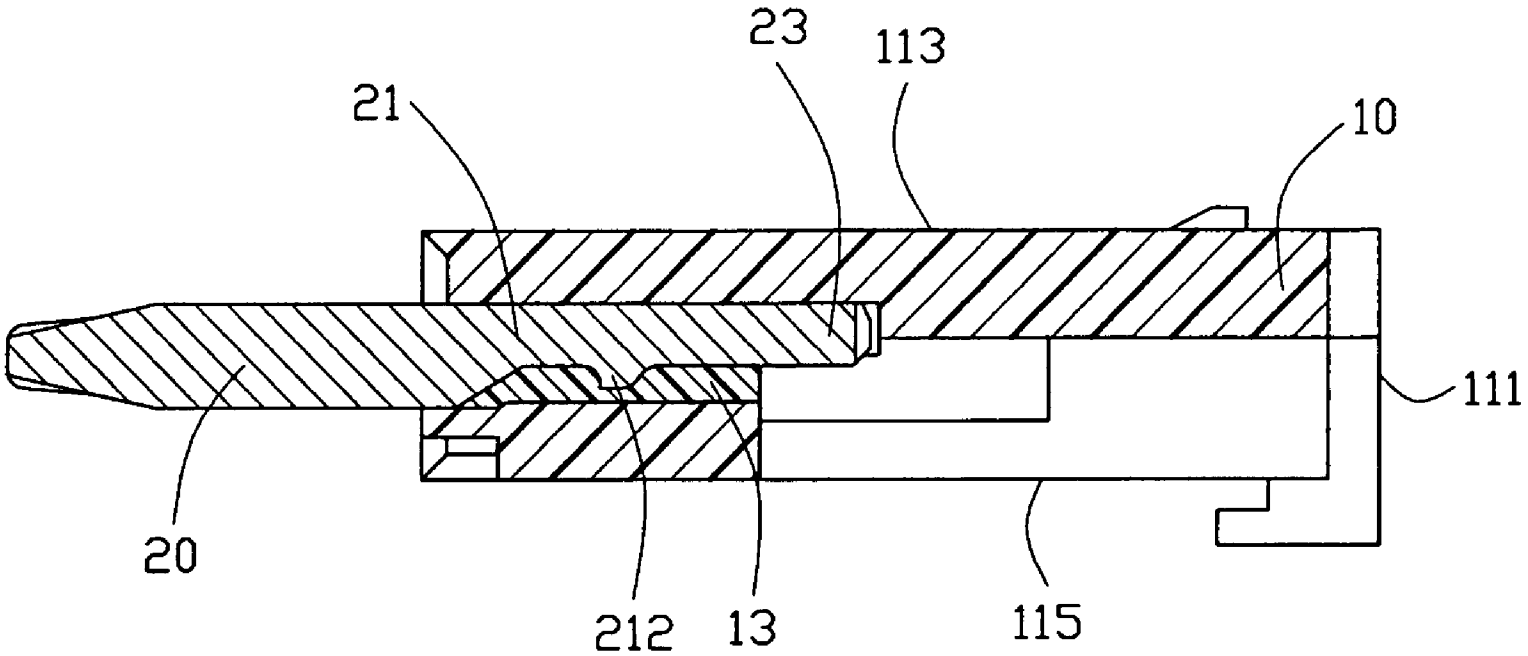
FIG. 4 is a cross-sectional view of the finished micro coaxial connector, taken along line 4—4 of FIG. 3.

The next step is molding the semi finished connector 100' to a finished connector 100. Referring to FIGS. 3 and 4, the first housing 10 mating with the terminals 20 is mounted in a molding cavity (not shown) of a molding apparatus. Some melt plastic the same as the material of the first housing 10 is injected into the molding cavity via molding openings (not shown) of the molding apparatus. When the temperature in the molding cavity is up to melting point of the first housing 10, the first housing 10 is molded with the melt plastic. The first housing 10 is fully mated with the terminals 20, and the melt plastic is turned into a second housing 13 that engages with the retention portions 21 of the terminals 20 and the first housing 10. Eventually, the terminals 20, the first housing 10 and the second housing 13 are engaged with each other fully and stably, so this method not only improve the retention force between the terminals 20 and the first housing 10 but also eliminate deformation of the first housing 10. In the preferred embodiment, the molding apparatus used in the above-mentioned step is also used for manufacturing the first housing 10.

Referring to FIG. 6 in conjunction with FIG. 4, a plurality of cables 30 are received in corresponding channels 114 to electrically and structurally connect with the terminals 20 of the finished connector 100.

The method in accordance with the present invention provides an effective and full connection between the terminals 20 and the first and the second housings 10, 13. Furthermore, it can effectively eliminate the deformation of the first housing 10 occurred in the process of assembling the terminals 20 to the first housing 10.

It is to be understood, however, that even though numerous characteristics and advantages of the present invention have been set forth in the foregoing description. Together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a first insulative housing defining a plurality of passageways;

a plurality of terminals inserted into the corresponding passageways, respectively, without substantial retention therebetween;

a second insulative housing injected into the first housing initially in a melt manner, and attached to not only the first housing but also the corresponding terminals after solidified, wherein said first housing provides a stop face abutting against a rear end of the terminal;

wherein the first housing has a base and a tongue portion extending from the base, and the passageways extends from the tongue portion into the base; and wherein the base has a cavity between the terminals and the passageways for receiving the second housing therein.

2. An electrical connector comprising:

a first insulative housing defining a passageway assembly;

a plurality of terminals disposed in the passageway assembly;

a second insulative housing inserted into a cavity of the first housing in a melt manner, and attached to not only the first housing but also the corresponding terminal after; and wherein said first housing provides a stop face abutting against a rear end of the terminal, wherein the first housing has a base and a tongue portion extending from the base, and the passageway assembly extends from the tongue portion into the base; and wherein the cavity accommodating the second housing is formed between the terminals and the passageways assembly.

* * * * *